United States Patent [19]

Vambutas et al.

[11] 4,364,244

[45] Dec. 21, 1982

[54] MEMORY CONTROLLED ELECTROMAGNETIC PASSIVE CONTROLLERS

[76] Inventors: Edmundas Vambutas, 369 Beverly Rd., Douglaston Manor, N.Y. 11363; John Feltham, 123 Elm Leaf Crt., Port Richey, Fla. 33568

[21] Appl. No.: 204,844

[22] Filed: Nov. 7, 1980

Related U.S. Application Data

[63] Continuation-in-part of Ser. No. 71,752, Aug. 31, 1979.

[51] Int. Cl.[3] ..... D04B 7/00; D04B 15/66

[52] U.S. Cl. ..... 66/75.2; 66/231; 66/238

[58] Field of Search ..... 66/75.2, 218, 219, 231, 66/232, 237, 238, 205

[56] References Cited

U.S. PATENT DOCUMENTS

| | | | |
|---|---|---|---|
| 2,234,271 | 3/1941 | Mehnert | 66/232 |
| 3,053,065 | 9/1962 | Steiger | 66/232 X |
| 3,370,443 | 2/1968 | Bentley et al. | 66/232 X |
| 3,478,543 | 11/1969 | Faninger | 66/205 |
| 3,653,232 | 4/1972 | Walter | 66/205 |
| 3,678,711 | 7/1972 | Schnieder et al. | 66/232 |
| 3,762,184 | 10/1973 | Schur et al. | 66/205 |
| 3,817,059 | 6/1974 | Krause | 66/237 X |
| 3,818,727 | 6/1974 | Hadam et al. | 66/127 |
| 3,825,900 | 7/1974 | Anderson | 66/205 |
| 3,969,912 | 7/1976 | Koukilk | 66/238 X |
| 4,285,217 | 8/1981 | Mista et al. | 66/205 X |
| 4,312,194 | 1/1982 | Cotte et al. | 66/752 |

FOREIGN PATENT DOCUMENTS

| | | | |
|---|---|---|---|
| 1186839 | 4/1970 | United Kingdom | 66/205 |

OTHER PUBLICATIONS

Gross, D., "Knitting Times", Untex's Electronic Control System Designed to Update Weft, Warp Units, 1979 (Reprint).

*Primary Examiner*—Ronald Feldbaum
*Attorney, Agent, or Firm*—Darby & Darby

[57] ABSTRACT

In flat-bed knitting machines and the like, where a plurality of machine levers are used to determine the type of stitch and pattern of the fabric being produced, the positioning of these levers is determined by solenoid-operated elements providing programmable stops for the machine levers. The knitting pattern is determined by the particular solenoids which are energized, which in turn is controlled by a program contained in an integrated circuit memory such as a PROM (programmable read only memory). The program and hence the pattern can be instantly changed by re-programming the PROM or by plugging in a different PROM.

19 Claims, 13 Drawing Figures

FIG. 1A
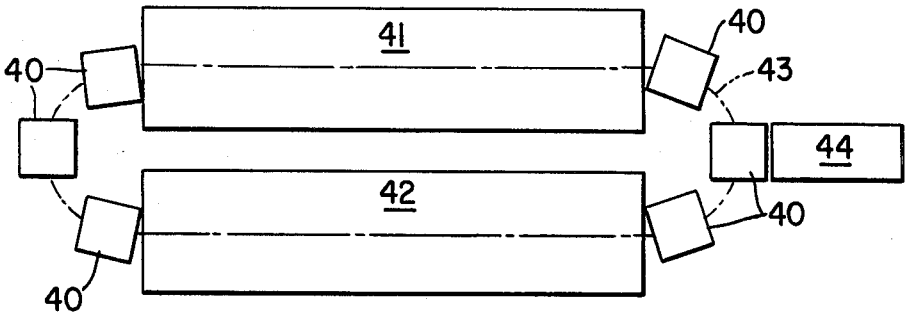
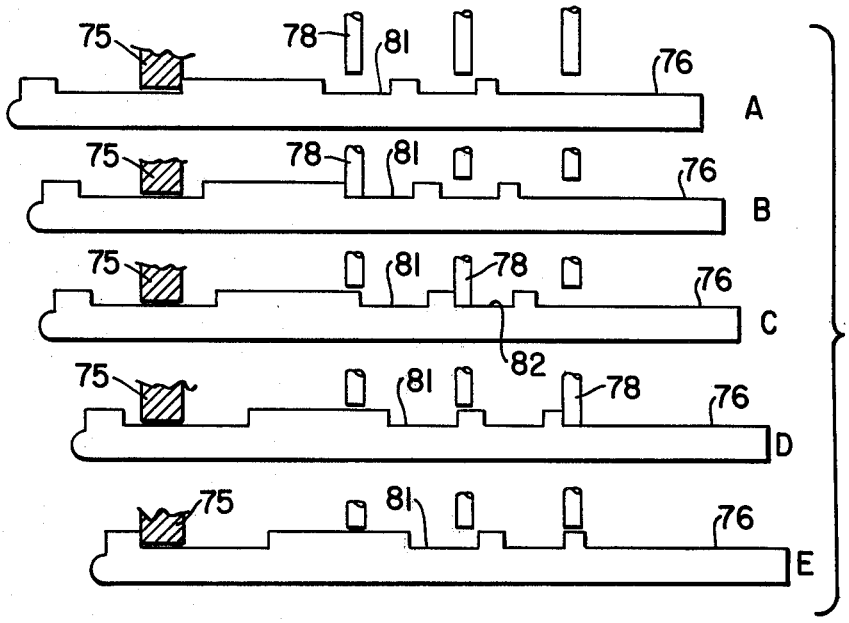
FIG. 11
FIG. 5
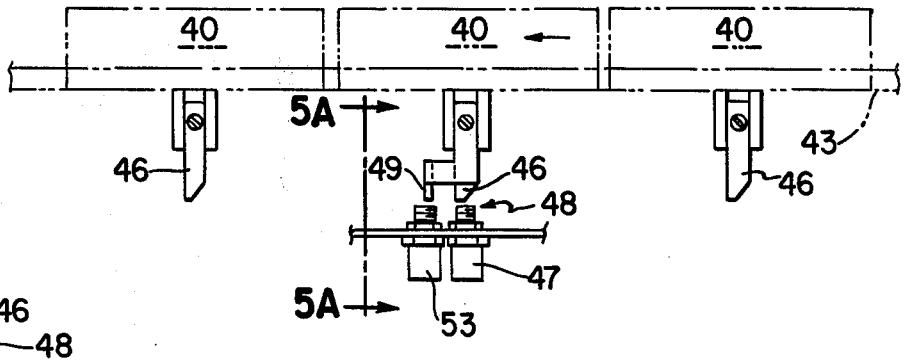
FIG. 5A
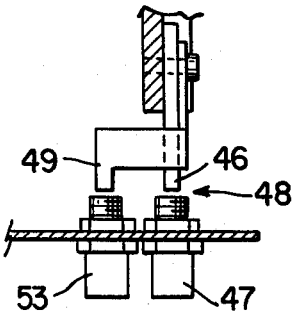

MEMORY CONTROLLED ELECTROMAGNETIC PASSIVE CONTROLLERS

This application is a continuation-in-part of prior application Ser. No. 71,752, filed Aug. 31, 1979 entitled "Memory Controlled Electromagnetic Passive Controller".

BACKGROUND

To control the type of stitch and patterns in flatbed knitting machines and the like, a plurality of machine levers are positioned at predetermined individual levels by means of some lever positioning device. A common type of positioner is a chain carrying a series of links which in turn carry raised portions the height of each which determines the arrested position of the corresponding machine lever. The machine levers are spring-loaded in the forward direction and are alternately retracted and advanced against the chain by a machine operated bail. A given chain carries a number of combinations of raised portions and is stepped a predetermined number of steps each time a new combination is called for. The stepping takes place each time a new yarn carrier is presented to the machine levers calling for the new combination. The chain carrying its raised portions (program) is a passive arresting device since the machine levers are alternately retracted and then advanced against the program chain.

A given chain carries a given program consisting of a predetermined sequence of raised portions. In a complicated control pattern a chain may be very long and heavy. In order to change a program, the chain must be removed from the machine and a new program chain installed. This is a cumbersome and time consuming operation. In order to provide a new and previously unavailable program, a new chain must be designed and built, which is a costly operation.

THE PRESENT INVENTION

In accordance with the present invention the program chain is replaced by an arrangement which includes a set of solenoids whose plungers serve as, or control, stops for the machine levers. In one form, a steel block houses a plurality of horizontal plungers, each plunger cooperating with a particular machine lever. A spring return forces each plunger against its corresponding machine lever thereby causing the plungers to follow the rocking movement of the machine levers. The forward motion of a plunger caused by action of its corresponding machine lever can be arrested by any one of a series of vertical stop pins which can be placed in its path. Each pin may be operated by an electromagnet which may be a part of a solenoid, or may be connected to a solenoid by a suitable linkage. The stop pins are contained in holes drilled at different distances along the holes and perpendicular to the holes carrying the plungers and correspond in function to the different heights of the chain links of the prior art.

The stop pins operate with a minimum of electrical power since they are located perpendicular to the plungers and serve merely as stops, and do not have to overcome any opposing force. The stop pins are actuated in accordance with a program carried by a solid state programmable memory device, such as a PROM (programmable read-only memory) or EPROM (erasable programmable read-only memory) or EAPROM (electrically alterable read-only memory). The program is stepped by a signal from a machine-operated counter or the like. In order to provide a new program, a new memory device is plugged in. For a different model of machine having different machine lever movements, a new block carrying a different arrangement of pin holes is substituted.

In another form, the machine levers cooperate with a set of notched sliding bars, which serve in the same manner as the plungers of the previously mentioned form. Each solenoid cooperates with a notch in a sliding bar, so that when the solenoid is energized its plunger enters the notch and serves as a stop for the machine lever. The position of the machine lever is thus made to correspond to the position it would assume if under the control of a raised portion of the chain being replaced. Each sliding bar has several notches, each cooperating with a corresponding solenoid to stop the sliding bar at an individual position required by the corresponding machine lever. By substituting other sliding bars, having slightly different notch positions, the present invention is readily adaptable to providing any of a large number of machine lever positions, as may be required for different models of knitting machines.

In addition to the operation described, a knitting machine may require auxiliary direct-acting motions which were previously also chain controlled—for example (but not limited to) jacquard-pattern-setting and needle-bed-racking controls. As the present invention dispenses with the control chain, these motions can be actuated by direct acting electromagnets which are also controlled and timed by the program of the memory device mentioned above.

The present invention thus reduces downtime in changing programs. Programming and machine set-up are simplified and are less expensive. Programming is made much more flexible. Adaptation to different machines or models is facilitated.

These and other advantages will be apparent from the detailed description of the various figures of the drawing.

IN THE DRAWINGS

FIG. 1A shows a diagrammatic sketch of one form of knitting machine with which the present invention is adapted to be used.

FIG. 5 is a schematic diagram of a sequence of yarn carriages carrying carriage-position sensors.

FIG. 5A is a partial cross-sectional view of a portion of FIG. 5.

FIG. 11 is a diagrammatic showing of the solenoid plunger/sliding bar relationship at various solenoid energizations.

Figure 1:
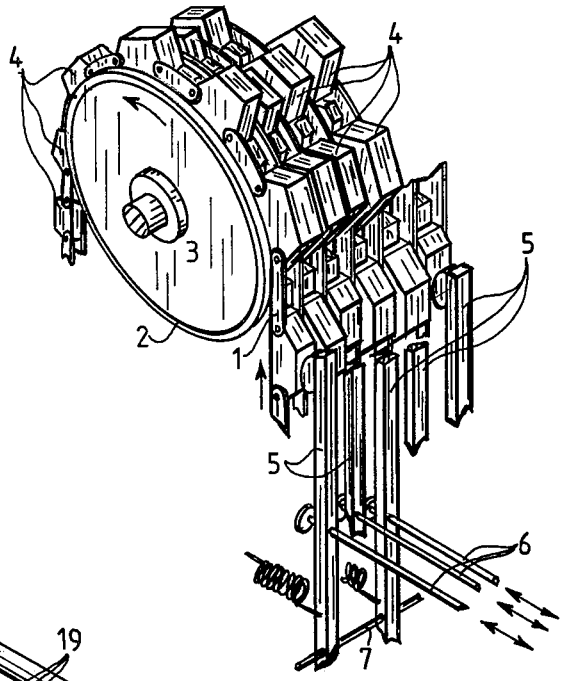
FIG.1 Prior Art
FIG. 1 shows a portion of a common type of prior art programmer employing a chain.

FIG. 1A shows a diagrammatic sketch of one form of knitting machine having two knitting needle beds 41 and 42 which are traversed by a series of yarn-carrying carriages 40 which continuously pass around a closed oval path 43. As each carriage 40 traverses the bed of needles 41 or 42, it lays one or more strands of yarn across the needles, and determines which of the needles are operative or inoperative, whereby the type and length of stitch as well as the pattern of used or unused needles is determined for that course of the yarn. These carriages may illustratively be fifteen in number, and rotate at such a speed that each makes a complete revolution in about nine seconds, with about 0.6 seconds time interval between passage of succeeding carriages.

In such a conventional knitting machine, each carriage is set so as to provide for each course the desired selection of yarns from its yarn carriers, and the desired type and length of stitch and arrangement of needles which are in or out of action, which determines the fabric design pattern to be produced. This setting is done as the carriage passes a fixed point such as the right-most end of the oval path 43. At this point, in the conventional machine, is located a programming device 44.

A common form of knitting program controller serving as a programming device has been a chain as shown in FIG. 1. This chain 1 is moved by a sprocket 2 rotated by a shaft 3. Sets of side-by-side teeth 4 are carried by the chain, each set cooperating with one machine lever. The teeth 4 of each set are of various predetermined heights which serve to arrest the corresponding machine lever 5 at various levels. The level at which a machine lever 5 is arrested determines the setting of the carriage 40 passing the programming control device 44, and in this way the particular operation in the knitting machine is programmed and controlled. This program is advanced by advancing the chain 1 one or more steps until a new desired program represented by the new row of chain teeth 4 is presented to the levers 5 to set another carriage as it passes. In some cases many program changes are required, up to as many as 1,000 or even more, requiring a like number of rows of teeth, so that the chain becomes long and cumbersome. When a new program which has not been built into a given chain is required, a new chain must be fabricated, which is an expensive and time-consuming undertaking.

According to the present invention, the knitting beds and carriage arrangements of the basic knitting machine are left unchanged, but the chain arrangement is replaced by the programmed controller device of the present invention, which appropriately stops the movement of the machine levers 5, so as to properly set the carriage for the desired knitting operation.

This program controller device, according to the present invention, has solenoids which in the manner described below determine the arresting position for each of the machine levers carried by the carriage.

Figure 2:
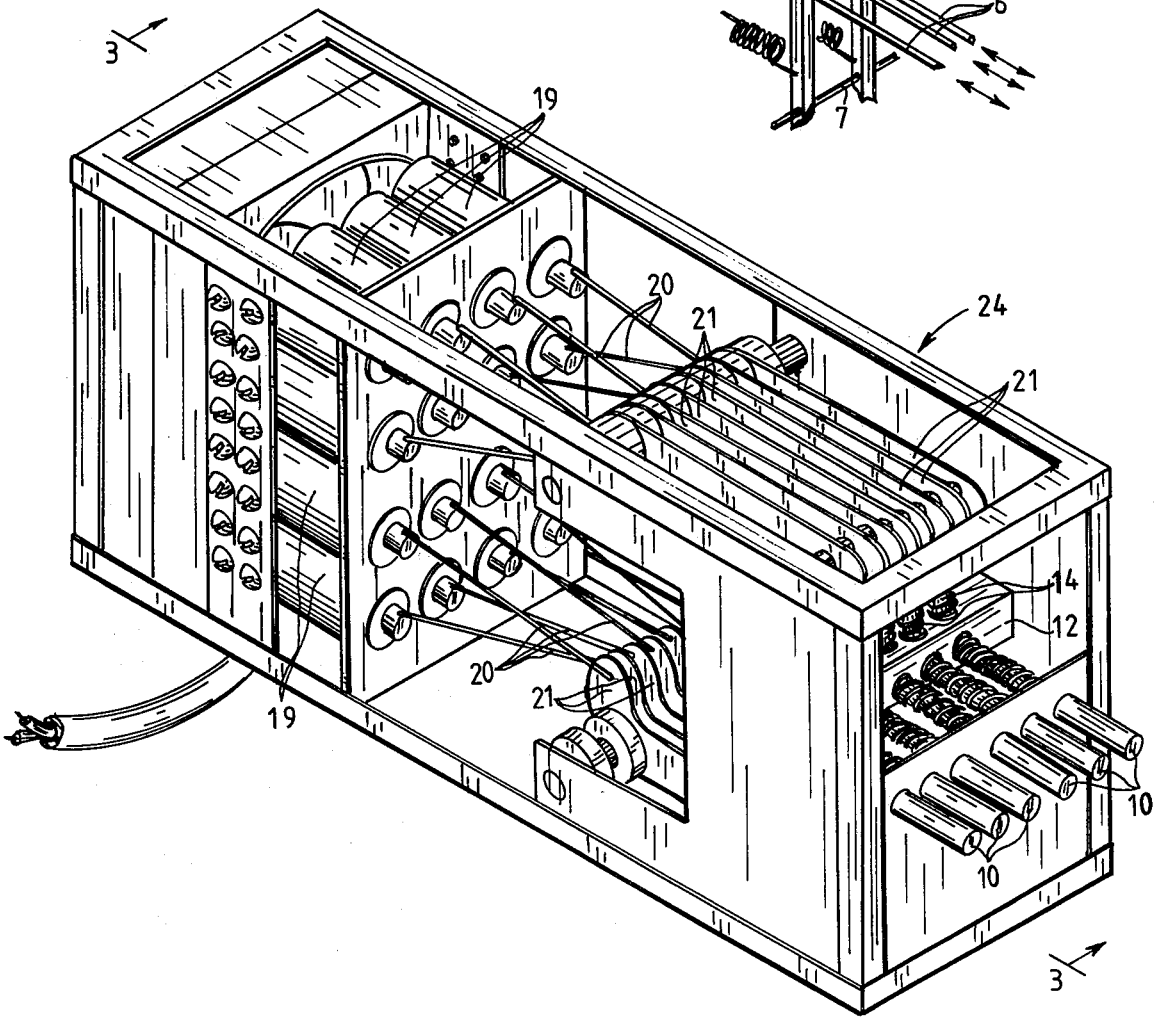
FIG. 2 is a perspective view of the mechanical portion of a controller in accordance with the present invention.
Figure 3:
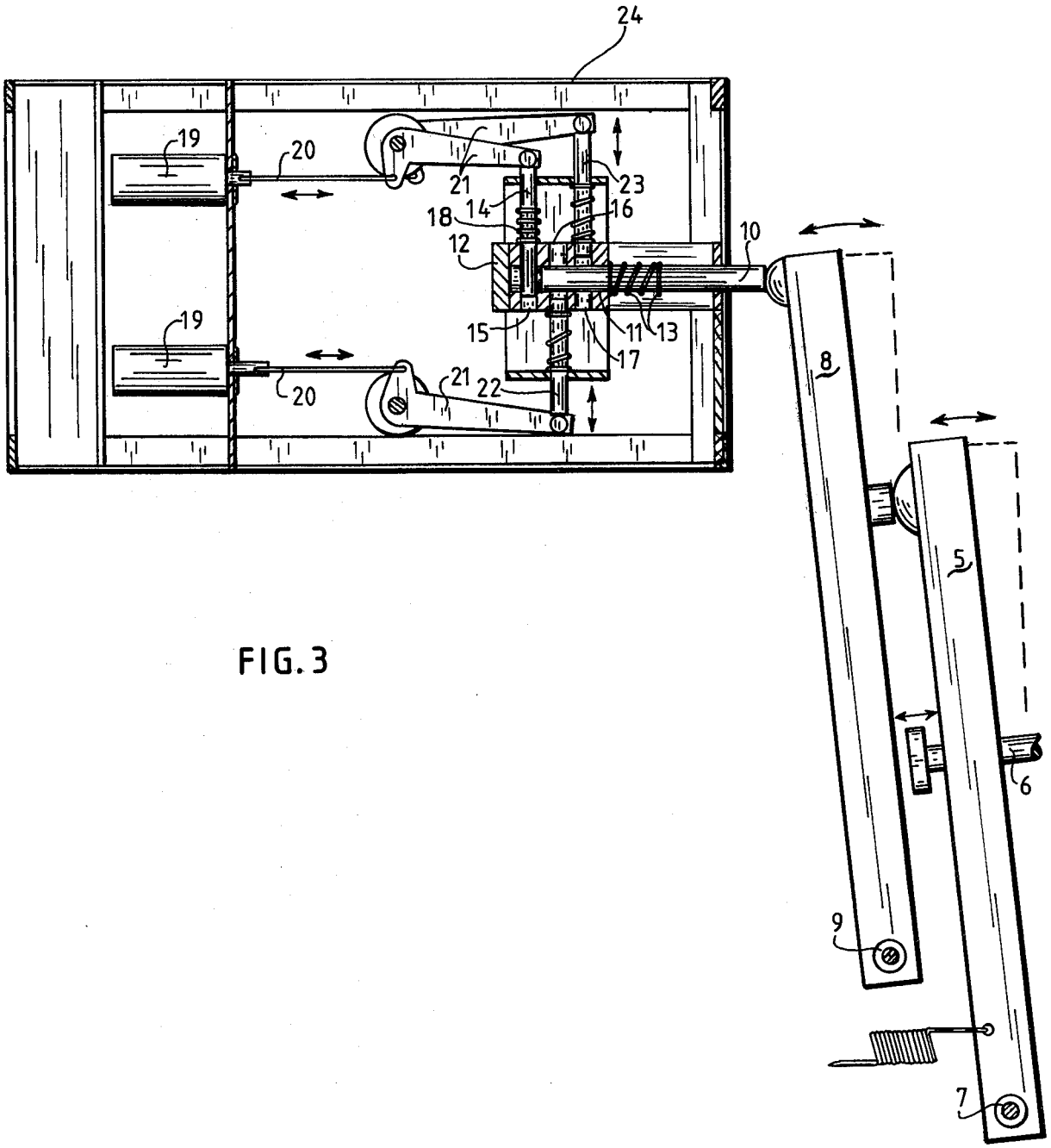
FIG. 3 is a cross-section taken along line A—A of FIG. 2.

FIG. 3 is a sectional view of one stage of a mechanical passive controller useful as a programming device in accordance with the present invention, which is also shown in perspective view in FIG. 2. Each machine lever 5 when released by retractor bail or press bar 6 moves against an intermediate lever 8 pivoted at 9 and pressed rod 10 moving in a hole 11 drilled in a block 12 against a return spring 13, until rod 10 is stopped by a pin such as 14, which rides in a transverse hole 15. In the figure, pin 14 has been selected to be moved in its hole 15 in accordance with a stored program to be explained in detail below. Pin 14 is pushed into hole 15 against a return spring 18 by an electrically actuated solenoid 19 acting through a link 20 and a bell-crank 21, thereby stopping rod 10 at a predetermined point and in turn through lever 8 restricting the position of machine lever 5 to a predetermined level, to determine the functioning of a portion of the knitting machine. Stop pin 14 thus serves in association with its sliding rod 10 as a stop element to determine the arrested position of a corresponding machine lever 5.

As shown in FIG. 3, there are three holes (15, 16, 17) extending across the hole 11 of block 12, each fitted with a respective solenoid actuatable pin (14, 22, 23) thereby providing three selectable stopping points which can be imposed on rod 10 and, in turn, providing four selectable advance positions for the corresponding machine lever 5; when no pin is actuated, rod 10 may move to the end of hole 11, providing the fourth position. By drilling holes 15, 16, 17 at other positions longitudinally with respect to rod hole 11, one or more of the selectable positions may be changed, as may be needed for differing machines.

Two important features of the system so far described should be emphasized. One is that the programming device is passive. That is, it does not have to exert power to move machine levers 5 but merely restricts their motion. The machine levers 5 are moved by the knitting machine and the present device acts as a stop for each lever at one selected point. The only power required is that which actuates the solenoids 19 to push their corresponding selected pins (14, 22, 23) into their predrilled holes (15, 16, 17) in block 12, with no opposing force. The other point is that intermediate lever 8 acts as a motion transformer so that a longer throw can be used by rod 10 while keeping the displacement of machine lever 5 at a predetermined lower value. By adjusting the pivot point 9, a fine adjustment is provided for the throw of lever 5 and rod 6.

FIG. 2 is a perspective view of an assembly of six rods 10 and sixteen solenoids 19 with respective links 20 and bell-cranks 21. Block 12 is shown carrying rods 10 and the perpendicular pins 14 etc., all assembled in frame 24. The number of rods 10, pins 14, 22, 23 and their actuators will depend on the application and requirements of the knitting machine being programmed. Rods 10 are coupled to machine levers 5 as shown and described above for a single actuator.

Figure 4:
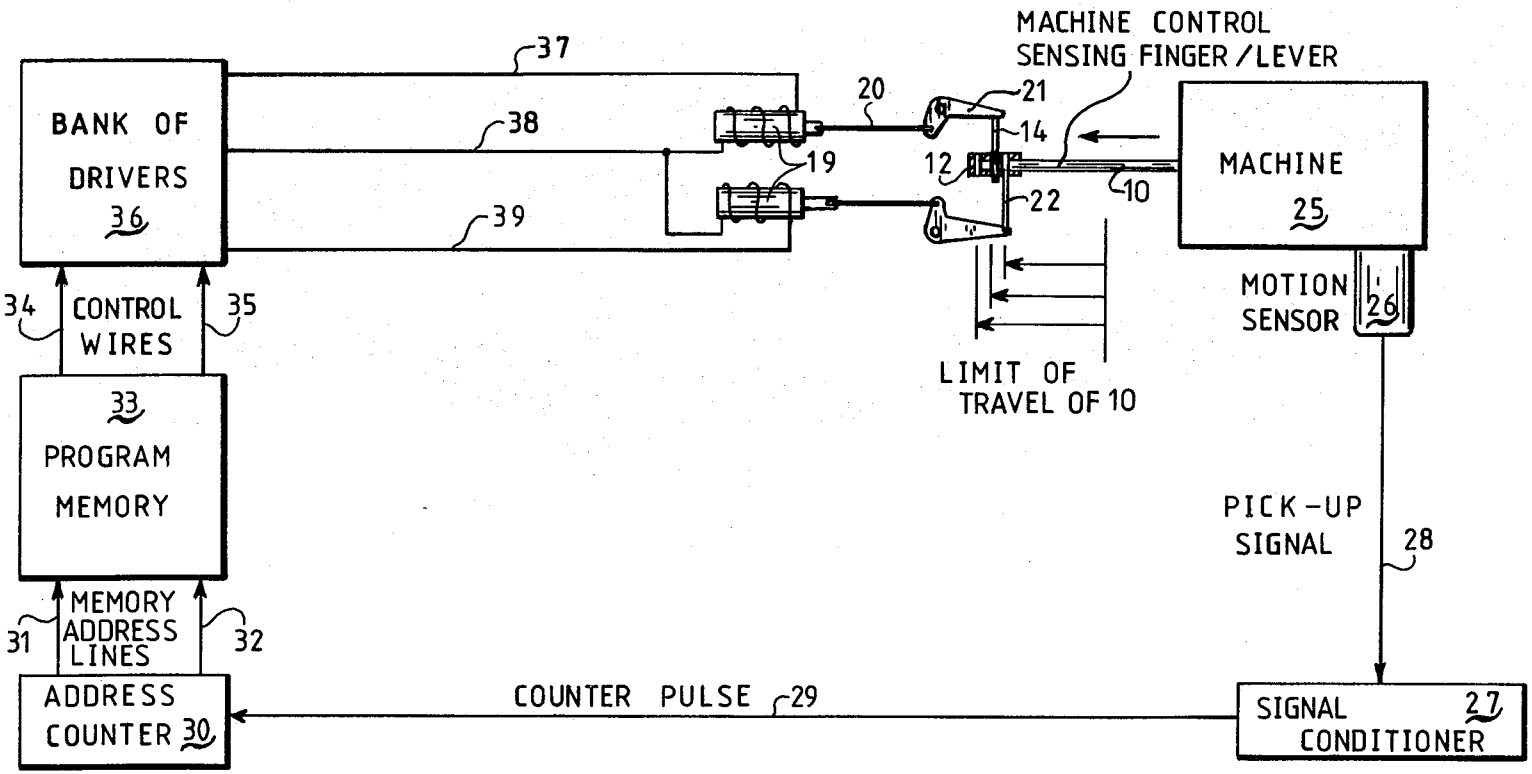
FIG. 4 is a schematic diagram of an electronic control system for a machine, according to one form of the present invention.

FIG. 4 is a block diagram of a complete programmed control device in accordance with the present invention showing, in particular, the electronic control system for the solenoid actuators. Since the mechanical portion of the system has been shown and described in detail above, it is shown in greatly simplified diagrammatic form in FIG. 4. The machine 25 being programmed is shown with a single rod 10 stopped by a pin 14 or 22 in a block 12 as described above. The details of the machine 25 and intermediate levers 8 coupled to rods 10 have been omitted for simplicity, since the emphasis in FIG. 4 is on the electronic circuit of the system.

The machine 25 has moving parts to be controlled, which is done by the passive actuator arrangement described above. However, an additional factor to be considered is the timing of the operation. The timing is initiated by a motion sensor 26 coupled to the machine 25. FIGS. 5 and 5A illustrate some details of one form of motion sensor 26 of FIG. 4 which may be used.

In order to assure proper cooperation between the various carriages and the operation of the program determining which solenoids are excited or energized (and accordingly the arrested positions of the various machine levers) each carriage 40 carries an extension arm 46 of a magnetic material such as iron or steel. In some instances, the thread-cutter operating lever already present in the carriage may be used as this metallic extension.

This extension 46 serves as a sensor in cooperation with a magnetic pickup 47 (which may be of the Hall-effect type) which is mounted in fixed relation to the frame or bed of the machine at a position spaced from the sensor 46 by a small gap indicated at 48. Thus, as each carriage passes by the pickup 47, it will induce in the output of the pickup 47 an electrical timing pulse which is indicative that the next carriage is about to be placed into operative relationship with the program control device 44. The sensor plate 46 and the magnetic pickup 47 constitute a motion sensor shown diagrammatically at 26 in FIG. 4.

The timing pulse signal from the carriage pickup 47 appearing on line 28 is passed to a signal conditioner 27 constituted by conventional amplifiers and pulse shapers to produce a desired conformation for the signal, which is fed over line 29 as a counter pulse, to an address counter 30, of conventional form, which counts up the counter pulses received and produces an output corresponding to the accumulated number of pulses. This output is a digital signal representing a number which may vary from 0 to the largest number of teeth in the chain replaced; illustratively this may be as high as 1,500 or more. Each value of counter output is used to represent a particular address in the memory. Thus, as each carriage approaches the control head position, a pickup pulse is produced which steps the counter to the next value, and provides a signal representing another memory address.

Each counter signal provided by the address counter 30 is fed over lines 31, 32 to a solid state program memory 33, which as indicated above may be a conventional erasable PROM memory device, having various "addresses" therein, each corresponding to a data storage location in the memory. For each address (corresponding to a counter value output from the address counter) there is stored in the program memory respective coded data which represent the desired carriage setting to create the desired functioning or operation of the knitting machine, for the passage of the particular carriage whose sensor plate has created the latest counter value. In addition, the stored data may include data coded to separately control other functions of the machine, and to serve as special instructions for additional functions of the electronic system, as described below.

The program memory device 33 also includes decoding circuits which respond to the address-representing counter output to seek out the "address" corresponding to the counter value supplied to memory 33, and then provide output signals corresponding to the data stored at the particular address. By way of illustration, for a system having 16 solenoids, the output signals may be a set of 16 bits, each having a "high" (or "one") state and a "low" (or "zero") state, corresponding respectively to a desired energization or de-energization of a respective solenoid. These output signals are supplied over the control wires 34–35 to a bank of drivers 36 which energize the set of solenoids 19, to operate the stop pins 14, 22, 23, as over links 20 and bell cranks 21.

Figure 6:
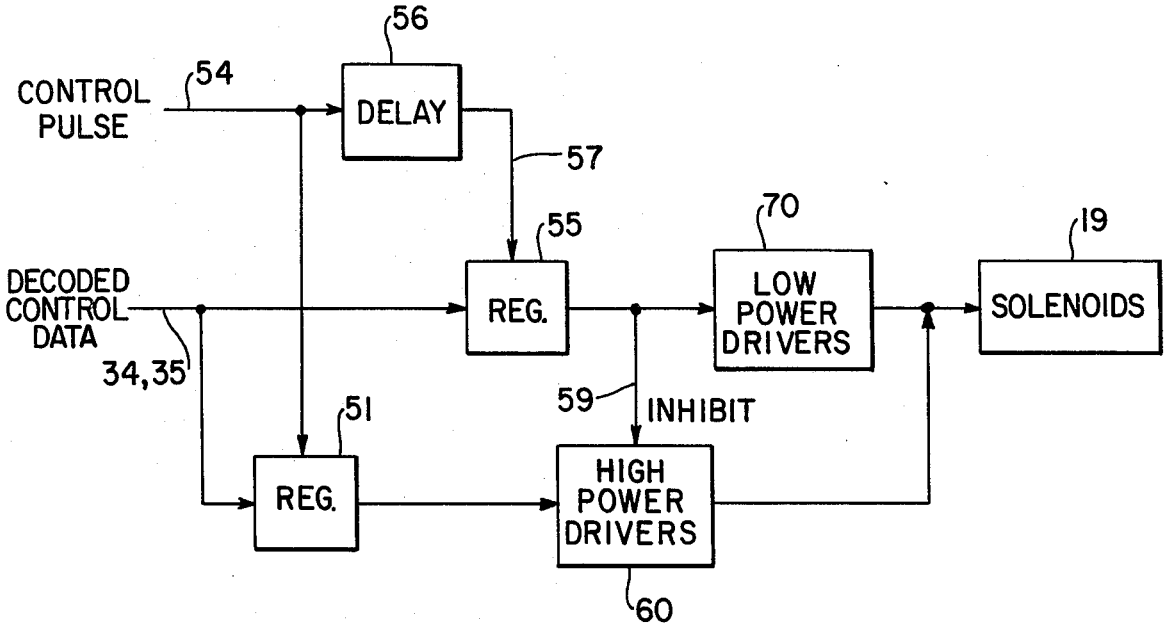
FIG. 6 is a functional block diagram of a solenoid-controlling arrangement.

As indicated schematically in FIG. 6, the decoded output data signals from the memory are supplied to a first register 51 to which is also supplied a control pulse over line 54, derived from the pickup pulse at line 28 or thecounter pulse at line 29 of FIG. 4. Each time a control pulse appears at line 54, register 51 stores the decoded data from memory 33, corresponding to the desired energizations of the set of solenoids 19. Thus at any one instant the signals stored in register 51 represent the data stored in memory at the address which corresponds to the latest counter output.

The same decoded data is also supplied to a second register 55, to which is also supplied over line 57 the control pulse of line 54 after a time delay determined by delay circuit 56. This time delay is less than the period between successive pick-up pulses. As shown below this time delay is substantially the desired time for high level energization of the solenoids 19.

The present system provides two ways of economizing on the energy required for actuating the solenoids. The energy needed to actuate each solenoid 19 quickly and positively is considerably greater than that required to hold the solenoid in actuated position. Accordingly, for economy of energy, after a predetermined delay sufficient for movement of the solenoid plunger to actuated position (such as 150 milliseconds) the energization of the solenoid is reduced to a lower level to hold the solenoid in its actuated position. In addition, there are many instances in which a particular solenoid may be needed to be energized for two or more successive carriage positions. This is done by retaining the solenoid in actuated condition (instead of de-energizing or re-setting it after each step of the program) until it is required to be de-energized for a later step. These features are present in the circuit of FIGS. 6 and 7.

In FIG. 6, each register 51 and 55 has as many outputs as there are solenoids, each output producing a signal for controlling a respective solenoid. Each output has a high-level or "one" state (when its solenoid is to be energized) or a low-level or "zero" state (when its solenoid is to be de-energized). These outputs are supplied to a corresponding set of high-power drivers 60, each of which controls the energization of a respective solenoid 19.

Assuming that all solenoids (16 in number, for example) are de-energized, then the occurrence of a control pulse on line 54, corresponding to a new program step, will cause register 51 to store the decoded control data for that program step. Certain of the register outputs will then be "high", and their corresponding drivers 60 will then energize the corresponding solenoids 19 with a high-level of current, which will serve to move the solenoid plungers sharply into the positions at which the corresponding stop pins (14, 22 or 23) coupled to those solenoids are inserted into the paths of the corresponding rods 10, to determine the arresting positions for the corresponding machine levers 5 required for the desired setting of the functions of the machine carriage.

The delayed control pulse on line 57 causes second register 55 be set to the same control data after the time delay period. However, during the time delay period, the register 55 retains the solenoid control data for the preceding program step. The outputs from register 55 then serve two functions. A first function is to turn off or inhibit the high-power drivers 60, by the inhibit connection 59. Thus, if for any solenoid the control data is "high" in the output of register 55, the corresponding high-power driver is turned off, or kept off, if already off. In the example given above, each solenoid desired to be actuated will then be cut off from its high-power driver. At the same time, the "high" outputs from register 55 are supplied to the low-power drivers 70, to continue the energization of those selenoids, but at lower (holding) energization.

Figure 7:
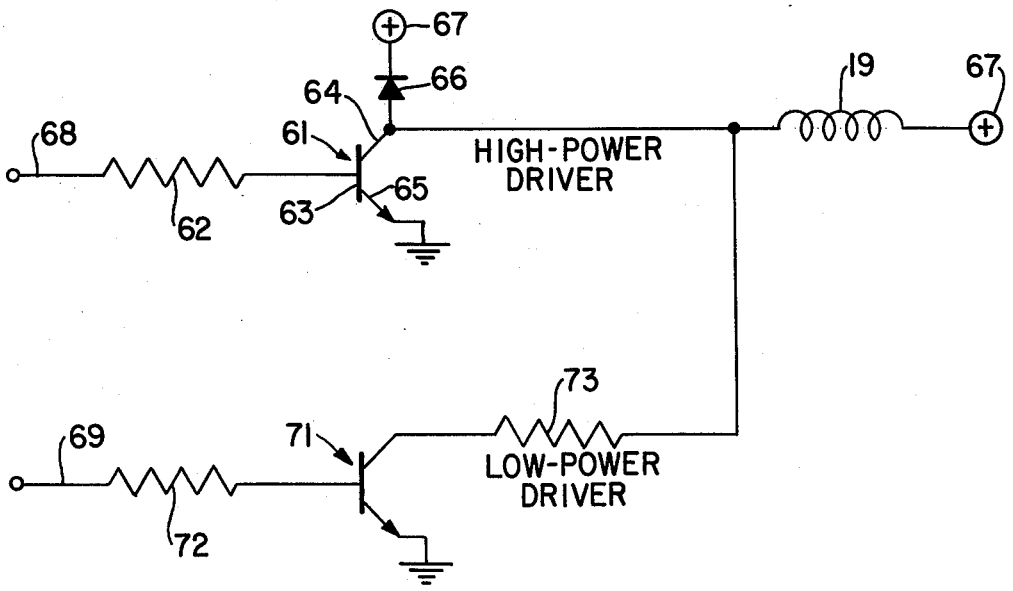
FIG. 7 is a schematic diagram of a solenoid driver circuit.

FIG. 7 illustrates one driver arrangement for one solenoid according to one aspect of the invention. As shown, this driver arrangement is formed of two transistor circuits, one of which is designated as a high-power driver 61 and the other as a low-power driver 71. The "high" or "low" output from the corresponding output of register 51 is applied to the transistor base 63 of the high-power driver transistor 61 at terminal 68 through a resistor 62. The transistor emitter 64 is connected by way of a clamping diode 66 to a source 67 of positive potential and is also connected directly to a solenoid 19 whose other terminal is connected to the source 67. In this way, upon occurrence of a positive pulse representing a "one" state, the transistor 61 is turned on to energize the solenoid 19 with a relatively high level of current, which will serve to move the solenoid plunger sharply into the actuated position. The low-level driver is formed by transistor 71, having a circuit similar to that of high-level driver 61, but connected to solenoid 19 through a resistor 73. Upon occurrence of a positive ("high") signal from time delay circuit 56, current is supplied through solenoid 19; resistor 73 limits the current to a holding level, which keeps it in actuated position. At the same time, the time-delayed control signal is also applied with opposite polarity as an inhibit signal to terminal 68, to turn off the high-level driver.

Each solenoid actuation is maintained (at low-power energization) until subsequent data (derived from a subsequently selected memory address) produces a low-level or "zero" input to the low-power solenoid driver, whereupon the transistor 71 becomes non-conductive (transistor 61 already being non-conductive), to await a later "one" from a subsequent memory address. This serves to minimize mechanical wear, since the solenoids are not re-set or de-energized at the end of each program step, but are left in the same position for subsequent steps until a change is needed. If the next knitting course is to be the same as a previous one, either the data stored in the next address will be the same as in the previous address, or the previous stored data may contain a control signal to inhibit any change in memory output or register 51 output for one or more subsequent counts.

In this way, power is economized since high-level energization of a solenoid is only required when it is first actuated after being deenergized. Otherwise, only actuated solenoids require power, and that will be at low-level for holding. It will be understood that, in place of switching between high-power and low-power solenoid energizations as described herein, the low-power energizations may be "on" during the entire period of desired solenoid activation, being supplemented by additional power when the solenoid is first energized from a de-activated state, only for the brief period when high-level energization is desired.

Thus, as each carriage approaches the programming device, the pickup pulse produced by it steps the counter forward one step. This seeks out a new address in memory, whose stored data then causes appropriate solenoids to be actuated. These interpose corresponding stops in the path of the machine levers 5, so that, as the carriage passes the programming head, the carriage is set to the positions corresponding to the desired knitting design. As that carriage thereafter passes the knitting bed, one course of the fabric is knitted, with the appropriate color, stitch size and spacing, and operative needles, corresponding to the setting of that carriage.

Thus, the operation of all of these electronic components is tailored to a particular desired machine operation. The intelligence or program is controlled by the program memory 33 in which predetermined control programs are stored. The number of programs or program steps stored in a given memory device will depend on its capacity and the complexity of a given program or set of program steps for a desired knitted pattern. One or more programs may be changed by reprogramming the memory device or by plugging in a differently programmed memory device. The simplicity and convenience of this way of changing programs can be readily seen, when compared with the cumbersome and expensive chain control described in connection with FIG. 1 above.

In order that the operation of the electronic programming device may be put properly in step with the rotation of the yarn carriages, a particular yarn carriage may be designated as No. 1 and supplied with a second sensor plate or extension shown as 49 in FIG. 5, which cooperates with a second magnetic pickup 53 similar to pickup 47. Then, upon starting up the machine when first starting a knitting program, the programming system is arranged to be preset in a quiescent status until a pulse is obtained from second pickup 53. In response to that pulse the address counter is enabled to function, and the first entry of the program is set into carriage 1. The successive carriages which follow are then correlated to the successive steps of the program, as stepped by the address counter in response to pickup 47 as each carriage passes the pickup 47. Second pickup 53 no longer has any effect on the address counter.

The pickup 53 may be utilized for a second function, to assure that the system does not permit the programming device to get out of step with respect to the rotation of the yarn carriages. A separate counter is utilized to count the pulses derived from pickup 47, beginning with carriage No. 1. Assuming that 15 carriages are used, as an illustration, then unless fifteen such pulses are counted before the next pulse is derived from the carriage No. 1 pickup 53, either a warning is given or the system is shut down until it is determined what malfunction may have caused the situation. In this way, proper operation may be monitored continuously.

It will be understood that, in addition to the electromagnets 19 which serve to control the machine levers 5, additional electromagnets or solenoids may be utilized for separate functions, such as jacquard card enablement and setting, or needle-bed racking, or others. This is readily done by including data for controlling such other electromagnets in each set of data stored in the memory device 33, to operate these additional electromagnets as desired.

While the apparatus described above is highly effective in simplifying the substitution of one knitting program for another, and for creating new programs, it is essentially restricted to use for one group of machines, which have the same arresting points for the machine levers. However, machines of different manufacture, or different models of the same manufacture, may have different limit points for the machine levers. For example, in one model, for a particular control function, a machine lever may require a stop at ten millimeters from the end of travel, whereas in a different model or machine, that same function may require that the machine lever be stopped at fifteen millimeters from the end. Such a change is not readily made by the apparatus described above, which would normally require drilling further or different holes in the block 12, and locating the solenoids at different locations, and/or changing the linkages from solenoid to stop pin.

The form of mechanism described below avoids these limitations, and provides an arrangement by which the program controller of the present invention may be readily adapted for use with various machines having differing positions for the same machine levers.

Figure 8:
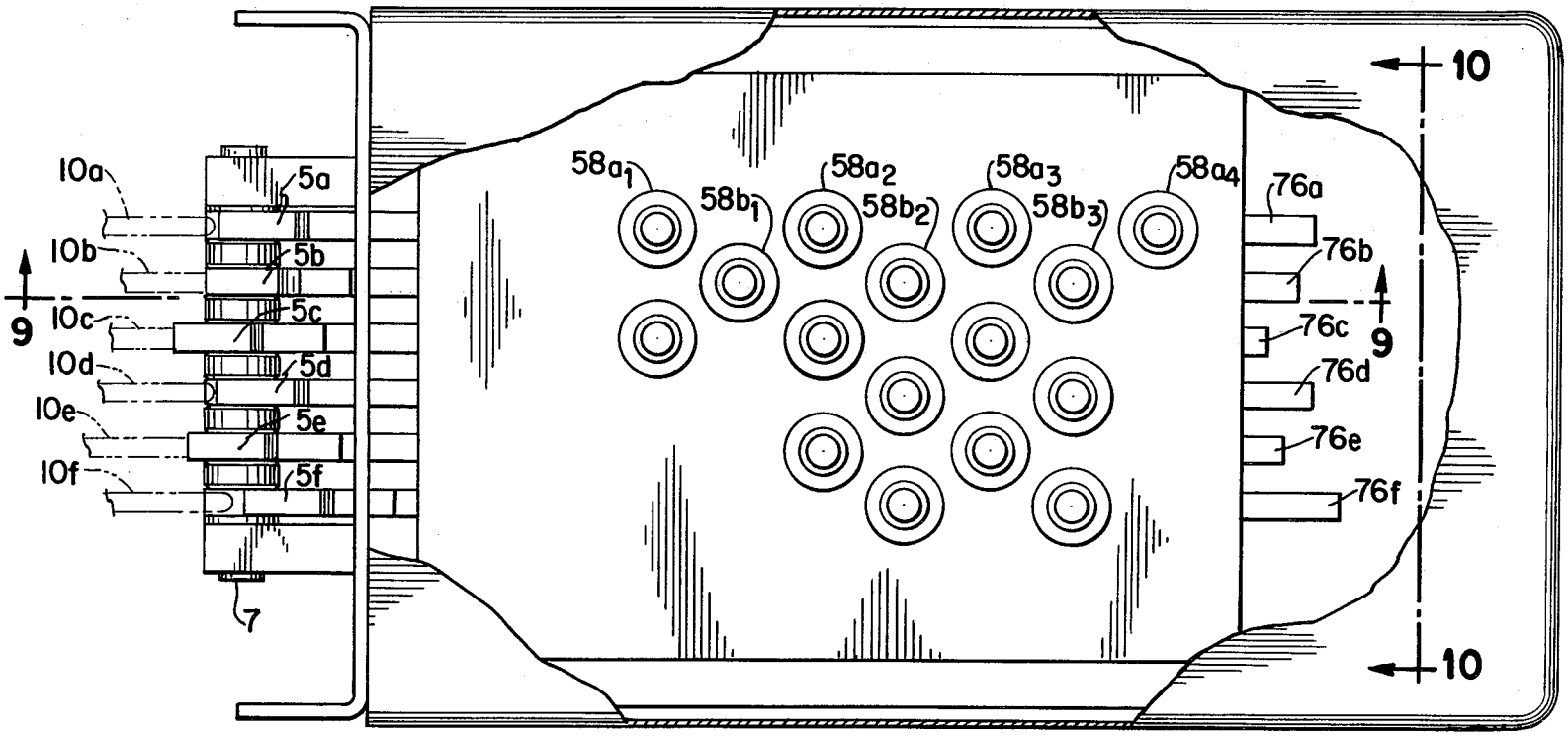
FIG. 8 is a top plan view, partly broken away, of a modified form of the present invention.

Referring to FIGS. 8 to 11, the machine levers 5*a* to 5*f* are all pivoted at 7. The conventional machine has a press bar (not shown) which alternately retracts all of the machine levers 5 simultaneously (to the left as seen in FIG. 8), and then releases them, so that they have a rocking motion during normal operation. The release of the press bar allows the machine levers 5 to rotate to a position determined separately in each case for each lever. In a conventional machine, the levers may be separately allocated to various functions. For example, lever 5*a* may determine which needles are in or out of operation. Levers 5*b* and 5*c* may control the vertical needles of the knitting needle bed, while levers 5*d* and 5*e* may control the horizontal needles, and these four levers then determine the length and type of the stitch. Lever 5*f* may control the yarn selection, as to which of a number of yarn spools on a carriage may be operative for a particular carriage traverse.

Figures 9, 10:
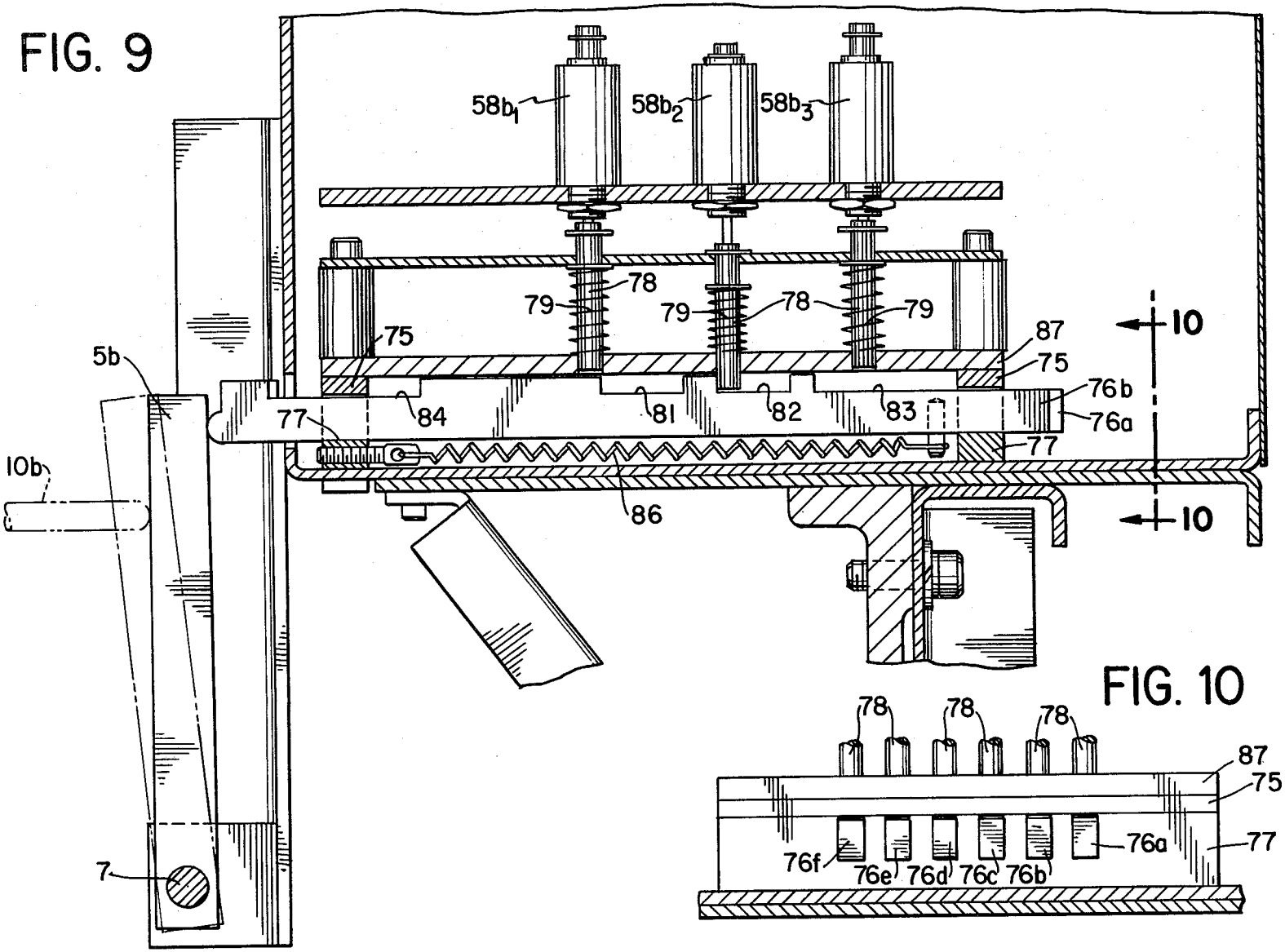
FIG. 9 is an elevation view, partly in cross-section, of FIG. 8, viewed along line 9—9 thereof.
FIG. 10 is a partial end view of FIG. 8, viewed along line 10—10 thereof.

In the form of the invention shown in FIGS. 8 and 9, each machine lever 5*a* to 5*f* cooperates with a respective sliding bar 76*a* to 76*f*. In this instance, six machine levers are shown, with a like number of sliding bars 76, although other numbers of levers may occur. The sliding bars 76 are guided between two low-friction comb-like elements 77 to permit ready horizontal sliding, while maintaining alignment with the respective machine levers 5. A pair of retaining bars 75 may be used to keep the sliding bars 76 within the slots of combs 77.

Mounted above the sliding bars 76 are a plurality of solenoids 58, each having a plunger 78. A number of solenoids (preferably corresponding to one less than the number of desired machine lever positions) is aligned with each machine lever 5 and over its respective sliding bar 76, so that the solenoid plungers would impinge upon the edge of the corresponding sliding bar when the solenoid is energized. Each plunger is normally biased in the retracted position away from the sliding bar by a respective spring 79.

FIG. 8 illustrates four solenoids $58a_1$, $58a_2$, $58a_3$, $58a_4$ aligned with bar $76_a$; three solenoids $58b_1$, $58b_2$, $58b_3$ aligned with bar 76*b*, and similarly three solenoids aligned with bar 76*c*, and two with each of bars 76*d*, 76*e* and 76*f*. Differing arrangements of solenoids may of coursebe used, depending on the functions to be performed by the corresponding machine bars. FIG. 9 shows illustratively bar 76*b* and its cooperating solenoids 58*b*, $58b_2$ and $58b_3$.

Each solenoid may be allocated to a respective knitting function, each corresponding to a particular individual position of the machine lever. For example, certain solenoids may collectively represent the function of needle control with different ones controlling different needle settings; other solenoids may represent the function of yarn selection; still others may represent the function of stitch length, etc.

Referring to FIG. 9, three solenoids $58b_1$, $58b_2$, $58b_3$ are aligned with one sliding bar 76*b*, which in turn cooperates with a machine lever 5*b*. The upper edge of sliding bar 76*b* is formed with a series of notches 81, 82, 83 and 84.

The sliding bars 76 are urged in the left direction by the tension springs 86 into contact with the machine levers 5, so that when the machine levers 5 are simultaneously retracted by the press bar, all of the sliding bars are also retracted to their leftmost position, shown diagrammatically at A in FIG. 11. In this position, the notches 81, 82, 83 are in general register with the respective plungers 78 of the solenoids 58. When any one of the solenoids $58b_1$, $58b_2$ or $58b_3$ is activated, its plunger 78 then enters its respective notch 81, 82 or 83. The notches are so arranged that the distance between each solenoid plunger and the left-hand wall or edge of the notch (as seen in FIG. 9 or 11) corresponds to the desired amount of permissible displacement of the machine lever 5 for the function or operation represented by that solenoid. FIGS. 11B, 11C and 11D show the relationship between each of the solenoid plungers and its notch when the corresponding solenoid is separately energized. As seen in FIG. 11, when the left plunger 78 descends, bar 76 is stopped in position B, where the left edge of notch 81 impinges on the advanced plunger 78. Similarly, when the center plunger 78 is advanced, notch 82 causes bar 76 to be arrested at position C, and for the right plunger 78 bar 76 is stopped as in D. When all three solenoids 58*b* are deenergized (with plungers retracted upward), the sliding bar 76*b* may be moved to its rightmost position, as seen schematically at E in FIG. 11, which in turn would permit the machine lever 5*b* to be stopped only at its rightmost position.

Thus the sliding bar 76 is caused to have different stopping points in dependence upon which if any solenoid is energized, and similarly the stopping point for the machine lever may assume the same corresponding positions. Machine lever 5*b* may thus assume any of the four positions represented by having any one of the three solenoids energized or none energized. Each plunger 78 thus serves in association with its cooperating sliding bar as a stop element to determine the arrested position of a corresponding machine lever 5. In these positions, lever 5*b* serves as a stop for the rod 10*b*, which in turn (through apparatus and structure not shown) is operative to set the corresponding structure of the yarn carriage as the carriage passes the control point on its rotation around the knitting beds.

The present arrangement has a further advantage over the first embodiment described above. In that first embodiment, either the solenoids had to be located in positions dictated by the necessary positioning of the stop pins, or else the linkages had to be individually designed to couple the solenoid plungers with the stop pins, with little opportunity for flexibility in varying the arrangement. The present embodiment, on the other hand, requires only that the solenoid plunger 78 and the notch in the slide bar 76 be in proper relative position, as determined by the requirements for the knitting machine (that is, the required stop positions for the machine levers). This relationship is quite flexible. The solenoids can be located conveniently from a mechanical or structural viewpoint, so long as the notches in the sliding bars are correlated to the plunger positions.

Also, to change the stopping positions of the machine levers (as for a different model of machine), it is only necessary to replace a sliding bar 76 (whose notches can be very simply fabricated) by another sliding bar whose notches are in the proper relationship to the solenoid plungers. In addition, the mechanical complexity of designing and constructing the individual linkages is eliminated in this latter embodiment, and the device can be fabricated more economically and maintained more readily in operation.

Both embodiments of the present invention offer additional advantages over the previous chain arrangement in the case of subprogramming for repeating subpatterns. Where portions of a knitted pattern are repeated, it is more economical to utilize the same portion of the stored program repeatedly, rather than to repeat the entries in the program, which may unduly lengthen the required capacity for the memory of the programming device. The present invention provides a simple way of accomplishing this, serving with far greater effectiveness the "economizer" function utilized with chain-controlled knitting machines, while simultaneously eliminating a number of the restrictions which have limited the functioning of chaincontrolled devices.

To accomplish this, in addition to the solenoid-controlling data stored at each memory address, coded control signals may also be simultaneously stored. A decoder circuit then recognizes a particular coded signal (which may be called the "subpattern commence" signal) as indicating that a repeatable portion of the program is about to be commenced. This signal also contains information as to how many times (N) that portion of the pattern is desired to be repeated. In response to that coded signal, the decoder then sets a subpattern counter to a value corresponding to N. The subpattern is then run through, actuating the successive carriages as before. At the last entry of the subpattern program, a further control signal ("subpattern end") is stored in the memory, which when decoded indicates that the pattern is to be repeated. This further signal then causes the address counter to step rapidly in the reverse direction until the "subpattern commence" signal is detected (and simultaneously reduces the number stored in the subpattern counter by 1). This stepping is done extremely rapidly, in a matter of microseconds, during the interval between passage of two carriages.

Upon detecting the "subpattern commence" signal, the address counter immediately reverses its direction again, and the program then proceeds as it did initially, stepping through the various steps of the subpattern until the "subpattern end" signal is detected, whereupon the cycle is repeated until the subpattern counter has successively stepped from N down to zero. Upon its attaining zero, the "subpattern end" signal is disabled, and the program continues forward from that point, having repeated the subpattern N times. The implementation of this subpattern control arrangement is within ordinary skill in this field, and need not be described in detail.

In general, both embodiments of this invention, and other variations within the scope of the present invention, permit the replacement of the cumbersome and costly toothed chain arrangement with a compact adaptor or attachment unit serving all of the functions of the chain and more, with far greater flexibility, ease of adjustment and replacement, and greater economy.

While the preferred forms of the present invention have been shown and described above, variations in detail are possible within the spirit and scope of the invention as set forth, in particular, in the appended claims. For example, while the restraining pins are shown as operated by bell and crank means, they might also be operated by solenoids directly.

What is claimed is:

1. A controller for a machine having a plurality of movable members each adapted to determine one or more functions of said machine in correspondence with any one of a plurality of positions of said member, said machine being adapted to have a sequence of statuses with each status corresponding to one set of positions of said movable members, said controller comprising one or more movable stop elements adapted to interact with each of said movable members, each stop element being adapted in one position to determine a respective position for its respective member, an electromagnetic device adapted to interact with a respective stop element to cause it to assume its one position determining the position of its respective movable member, a counter actuated by each change of status of said machine for producing a counter signal representative of the number of such changes, a memory device coupled to said counter and adapted to contain a set of stored data for each value of said number, each stored data set representing a set of actuations of said electromagnetic devices corresponding to a set of desired positions of said machine members, said memory device also including a circuit responsive to said counter signal for producing signals representing the stored data set corresponding to the number represented by said counter signal, and a control circuit for actuating said electromagnetic devices in response to said last-named signals.

2. A controller as in claim 1 further including means for changing the counter signal to which said circuit is responsive to correspond to a different number which is less than said change-representative number by an amount equal to the number of changes in a subpattern to be repeated.

3. A controller as in claim 1 wherein each said electromagnetic device is actuated initially with high energy and thereafter continuously with a lower holding energy until a subsequent machine status is reached requiring de-energization of said electromagnetic device.

4. A controller as in claim 1 wherein said stop elements are stop pins, insertable across the bore of a bored block at any of a plurality of positions along said bore, said bore containing a slidable bar adapted to be interposed between each movable machine member and its cooperating stop pins to arrest the movement of said member.

5. A controller as in claim 1 including a slidable notched bar cooperating respectively with each machine movable member, each said stop element being insertable in a respective notch to determine the position of said member.

6. A controller as in claim 1 wherein said memory device is programmable to change said stored data sets, to correspondingly change the functions of said machine.

7. A programmed controller for arresting in one or more position is each of a plurality of individually positionable machine members of a flat-bed knitting machine or the like in correspondence with each advancement of said machine from one status to a subsequent status, said controller comprising:

a stop device cooperatively associated with each of said machine members and including one or more stop elements each adapted to arrest movement of its respective machine member at an individual stopping position, an electromagnetic device associated with each stop device to place a stop element thereof in stopping position upon actuation of said electromagnetic device, a sensor responsive to advancement of said machine from one status to another, a counter actuated by said sensor for producing a counter signal representative of the number of such advancements, a memory device adapted to contan a set of stored data for each value of said number, each stored data set representing a set of actuations of said electromagnetic devices corresponding to a set of desired arrested positions of said machine members, said memory device including a circuit responsive to said counter signal for producing signals representing the stored data set corresponding to the number represented by said counter signal, a driver circuit responsive to said last-named circuit signals for actuating said electromagnetic devices in accordance therewith, whereby at each advancement of said machine its machine members are arrested at position is determined by said stored data.

8. A controller as in claim 7 wherein each said stopping device includes a slidable member associated with the respective machine member and one or more stop elements associated with said machine memeber and arranged to be interposed to block the movement of said slidable member.

9. A controller as in claim 8 wherein said slidable member is a rod slidable in a bore, and each of said stop elements when in stopping position extends across said bore to block movement of said rod.

10. A controller as in claim 8 wherein said slidable member is a notched bar, and each stop element when in stopping position extends into a notch of said bar to block sliding movement of said rod.

11. A controller as in claim 10 wherein each notched bar is replaceable with a bar having notches in different locations, whereby the arrested positions of said machine members may be changed.

12. A controller as in claim 7 further including means for changing the counter signal to which said circuit is responsive to correspond to a different number which is less than said advancement-representative number by an amount equal to the number of machine advancements in a sub-pattern to be repeated.

13. A programmed controller as in claim 7 for a flatbed knitting machine having one or more carriages movable successively into operative relationships, each carriage being settable to determine a set of functions for said machine, said machine also having a set of movable machine members for setting the condition of each said carriage, each of said machine members being required to be arrested at one or more positions to determine the setting of said carriages and thereby the functions to be performed by said machine, wherein said sensor is responsive to movement of each carriage past a fixed point.

14. A controller as in claim 7 wherein said memory device is programmable to change said stored data sets, to correspondingly change the functions of said machine.

15. A controller for a machine having a plurality of separately positionable members, each adapted to be arrested in any one of a plurality of positions, comprising a multiply-notched movable bar associated with each positionable member, each said bar being resiliently urged in one direction against its respective machine member, one or more movable stop elements cooperatively associated with each of said notched bars, each stop element cooperating with a respective notch of said notched bar and each having a rest position and a stopping position at which movement of its respective bar in an opposite direction is arrested, whereby each positionable member is adapted to be arrested as to movement in said opposite direction at a position corresponding to the particular stop element which is in its stopping position, and an electromagnetic device associated with each stop element to move it from its rest position to its stopping position.

16. A controller as in claim 15 for a machine adapted to be advanced from one desired status of its positionable members to another desired status thereof, said controller further comprising means responsive to advancement of said machine from one status to a subsequent status for actuating certain of said electromagnetic devices, to cause said positionable members to be set in various combinations of arrested positions in correspondence respectively with various statuses of said machine.

17. A controller for sequentially controlling the states of a knitting machine or the like having a plurality of machine members having individually settable positions, each set of machine member positions determining a state of said machine, said controller comprising a pulse generator for producing a pulse signal representing a desired change of state of said machine, a counter responsive to said pulse signal for producing a counter signal representing the number of states through which the machine has passed, a memory device for storing sets of data, each set corresponding to one desired state of said machine, a detector responsive to said counter signal for deriving from said memory device data a set of control signals corresponding to said counter signal, and machine-member-controlling means for setting said machine members in positions corresponding to said control signals.

18. A controller as in claim 17 for repeating a sub-sequence of said states, said controller including means responsive to said memory device stored data representing the last state of said sub-sequence for lchanging said counter signal to represent the number of states through which the machine has passed decreased by the number of states in said sub-sequence.

19. A controller as in claim 18 for repeating said sub-sequence a predetermined number of times, wherein said memory device stored data representing said last sub-sequence state includes data representing the number of desired repetitions of said sub-sequence, said controller including a sub-sequence counter, and means responsive to said last-named data for setting said sub-sequence counter to a state representing said number of desired sub-sequence repetitions, means responsive to each repetition of said sub-sequence for changing said sub-sequence counter to a state representing one less number of times said sub-sequence is to be repeated, and means responsive to said sub-sequence counter for discontinuing repetition of said sub-sequence after the desired number of repetitions.

* * * * *